US008596504B2

(12) United States Patent
Haley, Sr. et al.

(10) Patent No.: US 8,596,504 B2
(45) Date of Patent: Dec. 3, 2013

(54) SLING FITTINGS AND SLING SYSTEM FOR A FIREARM

(75) Inventors: Travis D. Haley, Sr., Montrose, CO (US); Michael Matthew Curry, Dubai (AE); Andrew Kent, Toronto (CA); Michael T. Mayberry, Denver, CO (US); Michael D Morgan, Windsor, CO (US)

(73) Assignee: Magpul Industries Corp, Erie, CO (US)

( * ) Notice: Subject to any disclaimer, the term of this patent is extended or adjusted under 35 U.S.C. 154(b) by 758 days.

(21) Appl. No.: 12/688,775

(22) Filed: Jan. 15, 2010

(65) Prior Publication Data

US 2011/0017788 A1 Jan. 27, 2011

Related U.S. Application Data

(60) Provisional application No. 61/145,106, filed on Jan. 15, 2009.

(51) Int. Cl.
*F41C 33/00* (2006.01)

(52) U.S. Cl.
USPC ..... 224/150; 224/149

(58) Field of Classification Search
USPC ..... 224/150, 149, 257, 258, 217, 913; 24/2.5; 42/85
See application file for complete search history.

(56) References Cited

U.S. PATENT DOCUMENTS

| | | | | |
|---|---|---|---|---|
| 28,109 | A | 5/1860 | Singleton | |
| 156,614 | A * | 11/1874 | Whitney | 24/265 H |
| 698,571 | A | 4/1902 | Smith | |
| 780,660 | A | 1/1905 | Humphrey | |
| 796,982 | A | 8/1905 | Baribeault | |
| 881,462 | A | 3/1908 | Craig | |
| 1,041,434 | A | 10/1912 | Cooley | |
| 1,194,699 | A | 8/1916 | Badger | |
| 1,226,310 | A | 5/1917 | Clark | |
| 1,396,270 | A | 11/1921 | Grierson | |

(Continued)

FOREIGN PATENT DOCUMENTS

EP 0345194 A2 12/1989

OTHER PUBLICATIONS

Webpage. www.cdq.net/CDQFSM.php. CQD Forward Sing Mount. Feb. 3, 2007 Retrieved from archive.org.

*Primary Examiner* — Nathan J Newhouse
*Assistant Examiner* — Lester L Vanterpool
(74) *Attorney, Agent, or Firm* — Geoffrey E. Dobbin; Dobbin IP Law P.C.

(57) ABSTRACT

The present invention is a sling system utilizing a rear sling fitting for a long firearm, such as a rifle. Such fittings typically are positioned between the stock and receiver. It presents a fitting body with an aperture to slide over a rifle receiver tube and a connection bar extending from a reverse of the fitting body. A point-type sling attachment may then be attached to the connection bar and be able to slide left and right across the back of the weapon, allowing for quickly adaptable left or right positioning of the weapon. Registration geometry may be added and positioned to further allow interface with weapon geometry and prevent rotation of the fitting during use. The connection bar may be positioned on another component of the weapon, such as the receiver or the stock, should the weapon not have a receiver extension tube. A convertible sling and forward sling mount are also disclosed for cooperative use with the fitting, completing the system.

9 Claims, 13 Drawing Sheets

(56) References Cited

U.S. PATENT DOCUMENTS

| | | | | | |
|---|---|---|---|---|---|
| 1,474,030 | A | | 11/1923 | Hatheway | |
| 2,112,577 | A | | 3/1938 | Roberts | |
| 2,296,733 | A | * | 9/1942 | Paolino | 224/150 |
| D151,408 | S | * | 10/1948 | Richards | D22/109 |
| 3,211,351 | A | | 10/1965 | Somple | |
| 3,430,828 | A | | 3/1969 | Gregson | |
| 3,704,537 | A | * | 12/1972 | McKinzie | 42/85 |
| D226,480 | S | | 3/1973 | Mauro | |
| 3,752,127 | A | * | 8/1973 | Baker | 119/797 |
| 3,778,095 | A | * | 12/1973 | Carr | 294/74 |
| 4,571,872 | A | * | 2/1986 | Johnson | 42/85 |
| 4,713,905 | A | | 12/1987 | Dupuy | |
| 4,823,998 | A | * | 4/1989 | Johnson | 224/150 |
| 4,924,615 | A | * | 5/1990 | Ives | 42/85 |
| D317,810 | S | | 6/1991 | Rightnour | |
| 5,323,940 | A | | 6/1994 | Hart | |
| 5,802,756 | A | * | 9/1998 | Hightower | 42/85 |
| D415,239 | S | | 10/1999 | Fell et al. | |
| 6,012,246 | A | | 1/2000 | Robinson et al. | |
| 6,178,600 | B1 | | 1/2001 | French | |
| 6,325,258 | B1 | * | 12/2001 | Verdugo et al. | 224/150 |
| 6,354,034 | B1 | | 3/2002 | Norris, Sr. | |
| 6,536,154 | B1 | | 3/2003 | Norris | |
| 6,598,330 | B2 | | 7/2003 | Garrett et al. | |
| D495,870 | S | | 9/2004 | Verdugo | |
| 7,059,502 | B2 | * | 6/2006 | Johnson | 224/150 |
| D556,850 | S | | 12/2007 | Kincel | |
| D568,957 | S | | 5/2008 | Esch | |
| D584,789 | S | | 1/2009 | Swan | |
| 7,562,481 | B2 | | 7/2009 | Esch | |
| D607,078 | S | | 12/2009 | Chu | |
| 7,959,046 | B2 | * | 6/2011 | Burnsed et al. | 224/150 |
| 2002/0148080 | A1 | | 10/2002 | Sonju | |
| 2005/0034347 | A1 | | 2/2005 | Verdugo | |
| 2006/0048431 | A1 | | 3/2006 | Weir | |
| 2006/0162134 | A1 | | 7/2006 | Sun | |
| 2006/0254113 | A1 | * | 11/2006 | Esch | 42/85 |
| 2008/0061544 | A1 | | 3/2008 | Gleason et al. | |
| 2008/0263836 | A1 | | 10/2008 | Howell | |

* cited by examiner

SLING FITTINGS AND SLING SYSTEM FOR A FIREARM

CROSS-REFERENCES TO RELATED APPLICATIONS

The present Application claims priority as a non-provisional perfection of prior filed U.S. Provisional Application No. 61/145,106, filed Jan. 15, 2009, and incorporates the same herein by reference in its entirety.

FIELD OF THE INVENTION

The present invention relates to the field of firearms and more particularly relates to a sling fitting for attachment of a sling to a long firearm and an associated sling.

BACKGROUND OF THE INVENTION

Slings are regularly used with firearms to allow for a convenient method of carry and for weapon retention in dynamic environments. Traditional slings mount onto the bottom of a weapon at two points, fore and aft, allowing for suitable carry over long distances and may be used as a steadying aid to improve weapon accuracy. While it offers the user the ability to carry the weapon comfortably over the shoulder or securely across the back, the traditional, bottom-mounted 2-point sling hinders weapon usage in dynamic combat environments since the weapon is stowed in a non-useable orientation. While 2-point slings may be used in combat as an accuracy aid by being wrapped around the arm or other techniques, this encumbers the user through entanglement in the sling itself and is mostly useful only for long-range engagements.

Due to these limitations, side-mounted 2-point or 3-point slings were developed to allow for improved usage as these systems allow the user to carry a weapon comfortably on the front of the body in a usable low-ready position instead of over the back or shoulder. These systems typically incorporate the ability to carry over-the-back or shoulder, like a traditional sling, since these carry positions are useful for climbing, swimming, low (belly) crawling or when maximum frontal dexterity is needed when carrying supplies or wounded. While these slings were a major improvement over the traditional sling, they primarily were intended for use from a single-side and require manual adjustment to allow for transitions from side-to-side in dynamic situations. Additionally due to the amount of strap material used to wrap around the body they can also interfere with chest-mounted equipment, such as on load-bearing vests. Traditionally, sling swivels have been used to secure slings to the weapon. These swivels have taken many forms but they all have similar characteristics: namely, they are rotatable (swivel) about a point and are usually an elongated loop through which sling material may be threaded. They have been positioned on either side of the weapon, so that the sling may be said to be mounted on either side, or on the upper and lower surfaces of the weapon, so that the sling may be said to be mounted along the weapon, or a combination thereof.

Recently, soldiers have more frequently been encountering dynamic battle scenarios such as enemies at close range, urban and confined-space engagements which make a more nimble sling system necessary. One such sling in current use is what could be termed a point-type sling, like the SINGLE-POINT® sling by Wilderness Tactical Products, LLC. This style of sling connects to the weapon at a single point, usually on the side of the weapon, between the traditional fore and aft connection points of a 2-point sling. A point type sling usually mounts aft of the grip but forward of a traditional rear sling mount. The sling may be threaded directly through a loop that is mounted on the weapon or the sling may be furnished with attachment hardware that clips into a ring or quick-detach cup mounted to the weapon at that location. Regardless of the actual mounting method, this point type mounting allows for greater freedom of motion as compared to traditional 2-point slings which span most of the length of the firearm. Additionally they have less loose strap material to become entangled in chest-mounted equipment. However, one disadvantage of the point-type sling is that it requires constant hands-on control of the weapon during movement as otherwise it will swing like a pendulum and may become unwieldy when not in use. Furthermore due to the instability of this configuration, it is not optimized for comfortable carrying of the weapon over long periods of time or long distances.

Convertible sling systems have been developed to address the limitations of both the side-mounted 2-point slings and the point-type sling and allow the user to easily optimize the sling system for the mission at hand. This resolves many of the limitations of the individual carry methods by allowing the user to rapidly configure and select the mode of carry. However, even with the advent of the convertible sling system, there still exists a major limitation: the ability to rapidly transition the weapon from side-to-side without additional manual operations.

The use of any sling, by its nature, encumbers the user by placing the weapon on the user's body. While convenient for carrying the weapon and securing it against loss, slings must be inherently made for use of the weapon while the sling and weapon are still attached to the body of the user. Most slings account for this and will usually allow a user to assume the user's dominant shooting position (usually a left or right-handed stance, while standing, kneeling or prone). In the majority of situations up to this time, this allowance has been sufficient.

Due to the demands more frequently encountered close-range urban combat, there is need for multiple carry options and a quick side-to-side transition capability lacking in the prior art. The lack of this capability is particularly hazardous when hunting for a hidden enemy as, when looking around corners and other obstacles, a soldier must occasionally expose his or her body to obtain an appropriate look. To compensate for this obvious danger, soldiers will typically change their stance (i.e. going from a right-handed stance to a left-handed stance) in order to look around such obstacles and still cover most of their bodies with the obstacle they are looking around. This procedure is hindered (and depending on the configuration, prohibited) when using a sling that is hard mounted to one side of the weapon. In order to effectively look, the sling must be extended to its largest possible configuration or the soldier must simply remove the sling, which both eliminates its usefulness and creates a tangling hazard. What is needed then is a sling that can migrate between left and right-handed stances and accommodate other possible positions a user may use in the course of battle or for convenient carry and retention, while simultaneously maintaining the sling in a secure fashion on the weapon.

Generally, sling fittings are used to provide mounting points for one of more of the various sling types and configurations. Sling fittings are primarily produced in front, rear and more recently point-type varieties. As an example, the AR15/M16 was not designed to accept a point type sling but many such sling fittings are on the market today which modify the weapon and provide such mounts, each with their own individual advantages. For this system the mount is usually a plate that slides over a receiver tube of the firearm and resides between the receiver and the stock when the weapon is assembled. The plate then presents planar attachment loops along its sides to allow for connection of the sling. Loops may be small elliptical holes for point-sling attachment with a clip or elongated slots for threading sling webbing through the plate. In both cases the attachment point is planar, within the plane of the plate and along the side of the weapon. Being along one side of the weapon, then, presents the adaptability difficulties presented above.

The present invention includes a sling fitting with a transitional crossbar that allows a point-type sling to cross from left to right across the weapon. It presents registration geometry so as to interface with the weapon and keep the fitting from rotating. The present invention represents a departure from the prior art in that the fitting of the present invention allows for transitional use of a point-type sling so that it may be used in either a left or right-handed stance without detachment from the weapon, does not require manual adjustment, and allows a greater range of motion in general. It also still keeps the sling securely attached to the weapon. The invention also includes a sling convertible between a two-point and a one-point mounting with a rapid length adjustment feature to accommodate different modes of carry such as over-the-shoulder, across-the-back, two-point or point-type low ready.

SUMMARY OF THE INVENTION

In view of the foregoing disadvantages inherent in the known types of slings and sling fittings, this invention provides a sling fitting and associated sling capable of allowing advantageous positional shifts by a user of a firearm. As such, the present invention's general purpose is to provide a new and improved sling system that allows a point sling attachment to migrate between the left and right sides of a weapon receiver. In so doing, the sling fitting allows for left-handed or right-handed use of the firearm. Additionally a convertible sling which may be used with or without said sling fitting is designed to complement the functionality of that transition.

To accomplish these objectives, the sling fitting comprises a main body with an aperture allowing the body to slide over a receiver tube of a long firearm, such as an AR15/M16. Geometry is fashioned on the body to permit registration of the fitting with other parts of the weapon, such as the receiver and/or the receiver tube and stock. On a reverse side of the fitting, a connection bar is presented that crosses a central axis of the fitting such that a portion of the bar can be said to be on a left side of the fitting and another portion can be said to be on a right side of the fitting.

In use, a point-type sling mount is attached to the connection bar. This type of mount is essentially a clip or link that attaches the sling to the weapon. Being a non-threaded, mechanical interface, the point-type mount will be able to slide along the connection bar to either the left or right side. This interface structure then allows a user to hold the weapon in either a left-handed or a right-handed stance and generally allows more freedom of movement with the weapon, overcoming the drawbacks of the prior art. An auxiliary link may be present on the bar so that the sling may be attached to said link for greater articulation of the connection structure and, therefore, greater range of movement.

The sling then, will clip on the point-type sling fitting and a forward sling mount. When desired, the user may unclip the forward connection from the forward sling mount and position it on a specialized loop on the sling body for a one-point mounting centered upon the said sling fitting. The sling also presents a quick adjustment configuration by having a sliding buckle which controls strap length and is attached to a loop handle for easy manual operation.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

With reference now to the drawings, the preferred embodiment of the sling fitting is herein described. It should be noted that the articles "a", "an", and "the", as used in this specification, include plural referents unless the content clearly dictates otherwise.

Figure 35:
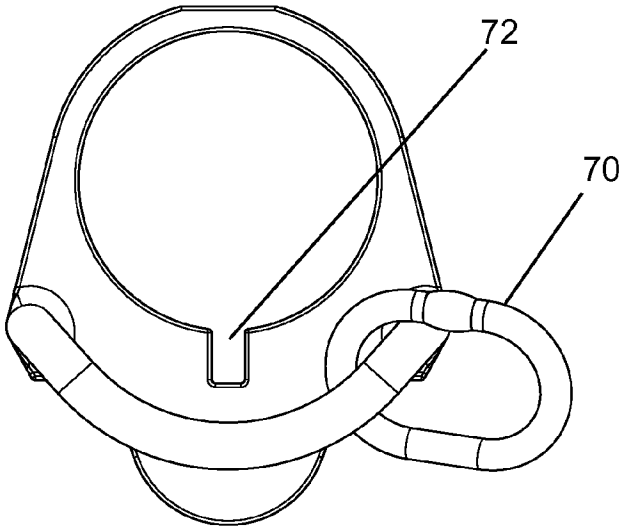
FIG. 35 is a plan view of an alternate sling fitting with an attached auxiliary link and different registration geometry than that of FIG. 3.
Figure 36:
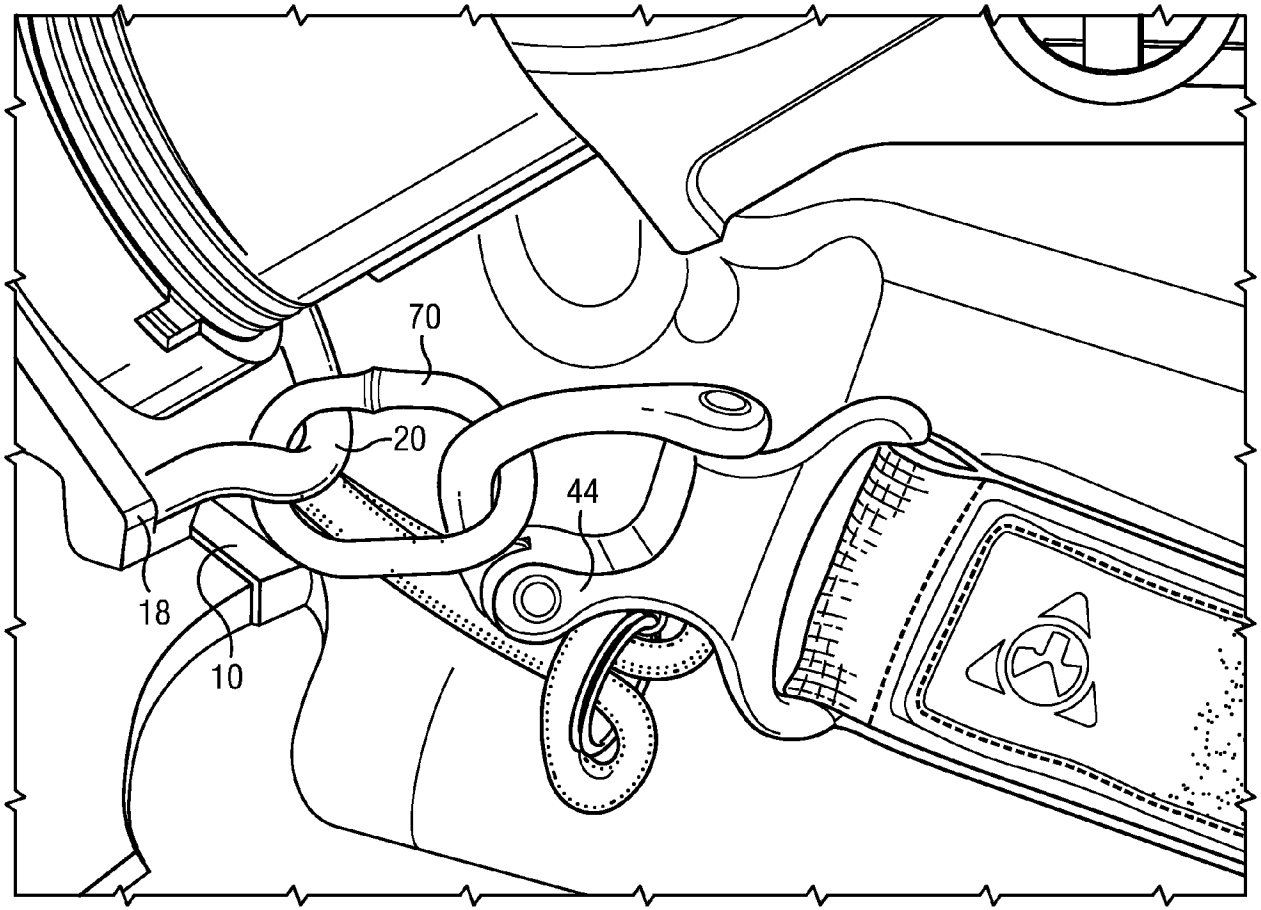
FIG. 36 is a perspective view of the sling fitting of FIG. 35 installed on a firearm with the sling of FIG. 29 attached.

With reference to FIGS. 1-14 generally, the rear fitting 1 comprises a main fitting body 10 with an ovular shape. The wider portion of the main body circumscribes and defines an aperture 12, through which a receiver tube will slide when the fitting 1 is installed. A registration tab 14 is present in the lower part of aperture 12, extending from the circumference of the aperture, to register the sling fitting 1 on the receiver tube, as the receiver tubes for adjustable and collapsible stocks have a distal grove throughout the length of the tube. For fixed stock applications, where no such groove is present, registration tab 14 may be omitted. The lower portion of the fitting body 10 is narrower and presents a registration body 16 and a connection bar 20, defining the obverse (with the registration body 16), and reverse (with the connection bar 20) of the fitting body 10. Registration body 16 projects perpendicularly from the fitting body 10 and is utilized to register the fitting into the receiver of a weapon and prevent rotation of the fitting 1, along with the registration tab 14. Registration body 16 may take any shape so long as it comports with the registration hole in the receiver. The depicted registration body 16 is an elliptical wall, radially spaced from a center of the aperture. It is to be easily understood that the registration body 16 may be a solid ellipse, or other shape, or it may even be a suitably sized nut welded in place. So long as it is appropriately sized and shaped to fit the receiver, the registration body 16 will work, and such variations of size and shape are to be understood to be included in this specification. Perpendicular projections 18 rise from the obverse of the fitting body 10 and also aid in registration of the fitting 1 into the receiver as these perpendicular projections 18 fit around the edges of the receiver, as shown in FIG. 36. These additional projections are added in the preferred embodiment, but could also be omitted. They may also be positioned, placed and formed in any manner to register with geometry of the weapon's receiver or stock. Registration tab may be omitted or replaced by alternate registration geometry, such as registration slot 72 in FIG. 35, depending upon the firearm with which the fitting is desired to be used.

Figure 32:
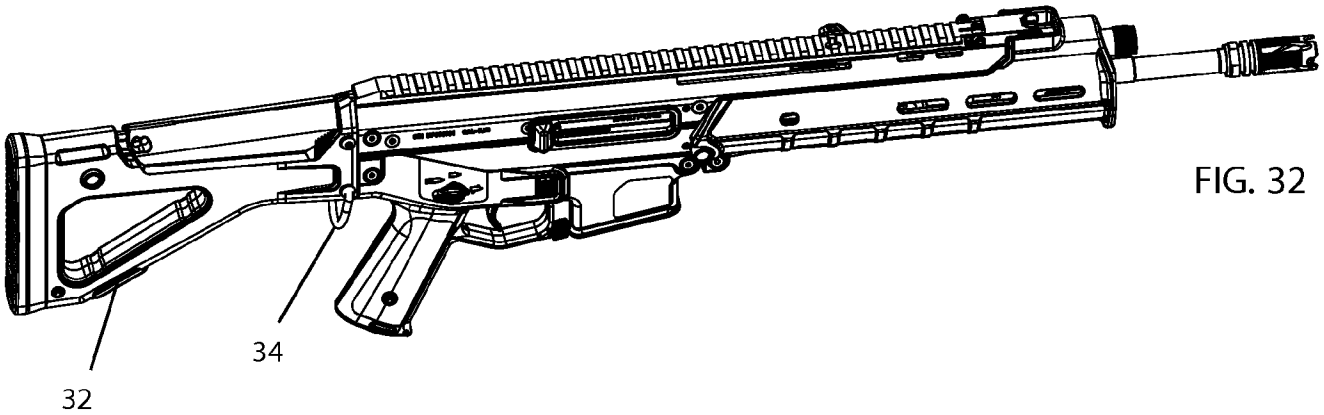
FIG. 32 is a top perspective view of a firearm with the integral embodiment of the connection bar used in the present invention.
Figure 33:
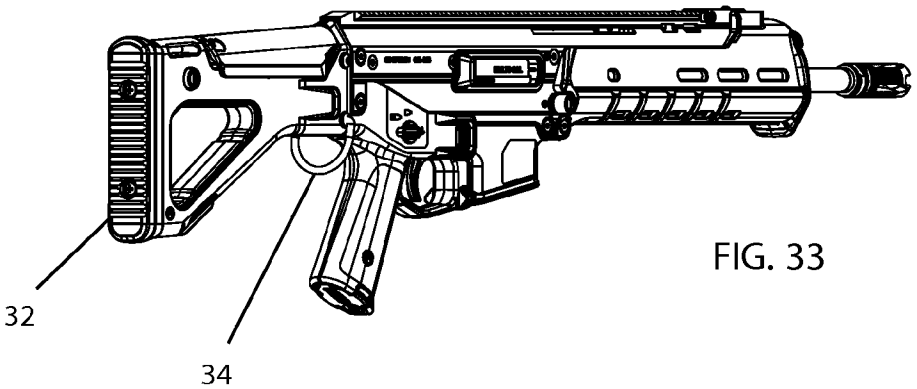
FIG. 33 is a bottom perspective view of the firearm of FIG. 32.
Figure 34:
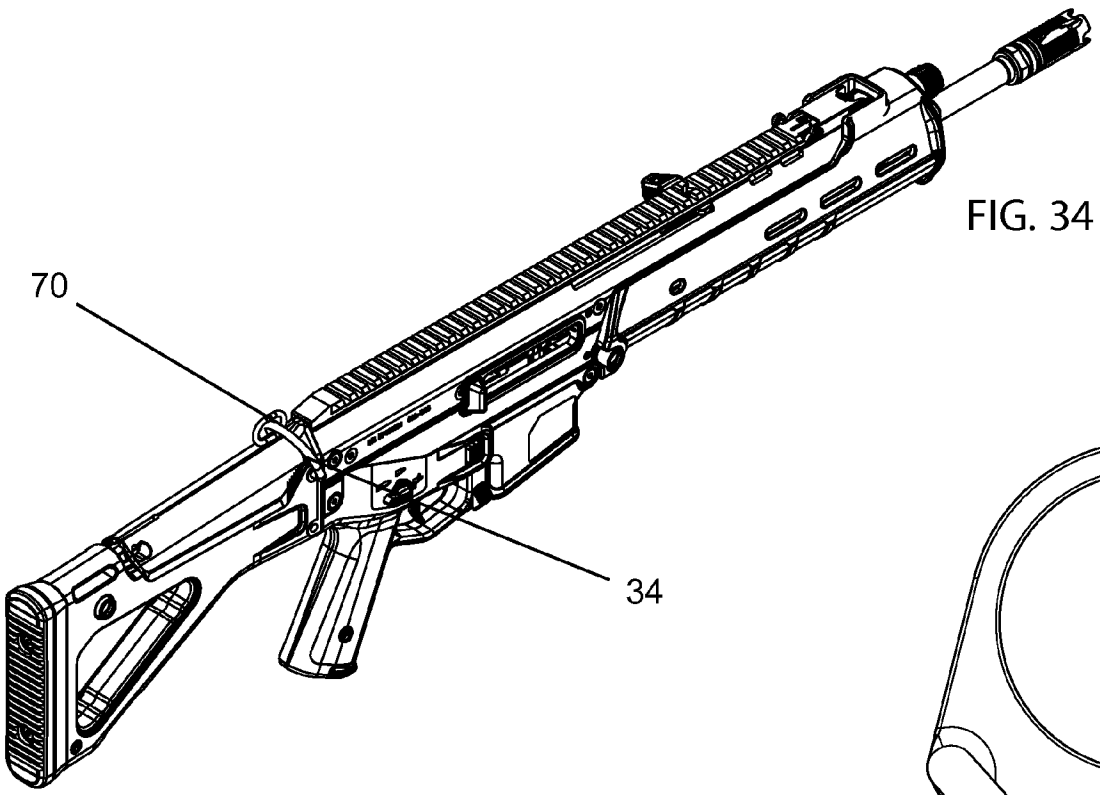
FIG. 34 is a top perspective view of a firearm with another embodiment of the integral connection bar used in the present invention.

For those firearms without a receiver extension tube, other weapon components, particularly the stock and/or receiver, may be made with a connection bar 34, as shown in FIGS. 32 and 33. In this embodiment, another main weapon component, such as stock 32, is fashioned with an added transverse connection bar 34 what is located in a distal location of the component, extends rearwards, and spans across the component from a left to right side with sufficient clearance to allow the sling to clip onto the bar and move from side to side. For top mounted sling systems, where weapon geometry may prohibit a distal mounting, connection bar 34 may be mounted dorsally, as shown in FIG. 34. Connection bar 34 may be fashioned integrally with the component or may be added later through any sufficiently durable connection means, such as welding, bolting, etc. In any event, the connection bar 34 must be rigid and maintain its orientation relative to the weapon so as to facilitate clipping of the sling to the connection bar 34 and eliminate possible length variance in the sling that could result from a non-rigid connection bar.

A forward sling mount 60 is also provided, shown in FIGS. 15-28. The forward sling mount is rail mounted for easy attachment and presents a connection loop 66 for attachment of sling attachment hardware. The forward mount features a main body 62 with a hooked end 64 that hooks beneath the loop 66. A bore/trough 68 extends through the hooked end 64 to allow a bolt passage therethrough and eventual connection with a generic connection block (not shown) to grip a rail.

In manufacture, the fittings may be made of any suitable material, including metals like steel and aluminum, and suitably strong plastics, though such plastics must be able to withstand intense heat and rigors of use. Any known method of fashioning the fitting may be employed, including but not limited to molding, stamping, pressing, casting, welding and soldering. Actual dimensions will be dependent upon the requirements for the type of weapon for which the fitting was made. As rails are ubiquitous, the dimensions for the forward sling fitting are easily ascertained. As an example, for an AR15/M16 rifle, the dimensions of the rear sling fitting should be approximately 1.8 inches at its widest point (where the connection bar 20 connects to the sling fitting) and should have an overall length of about 2.1 inches. The connection bar 20 should extend outward at least 0.2 inches from the fitting body 10 and have a diameter of approximately 0.2 inches or more, yielding a minimum overall projection of about 0.4 inches to the far edge of the connection bar 20. The thickness of the connection bar 20, being cylindrical body as opposed to a cut out slot, provides strength to withstand constant use from a point sling connection. A 0.2 inch gap between the connection bar 20 and the main fitting body 10 will allow most clips used with modern slings today to clip onto the connection bar 20 and slide along its length unhindered. The overall (planar) thickness of the fitting body should be about 0.1 inches, with extending geometry increasing that thickness as necessary. The aperture 12 should have a radius of about 0.6 inches and leave a minimum of 0.1 inches of a ring therearound. The connection bar 20 should occupy a plane parallel to a plane defined by the planar body, separated therefrom by two prong ends of the connection bar 20 that extend generally perpendicularly from it, though any angle that provides adequate distance from the main body 10 and maintains appropriate location of the connection bar 20, specifically beneath the weapon stock and behind the receiver, will be within the purview of the invention. The preferred structure of the fitting then, positions the connection bar 10 directly above the main body of the fitting 10. The connection bar 20 is immovable with respect to the fitting body 10. The fitting body 10, when installed, is fixed in position by the receiver tube and stock due to the registration structure of the fitting. As a result, the connection bar 20 maintains is position relative to the weapon. This is necessary for optimal performance and use as it provides consistency for the user to know how an attached sling should and will behave under use.

Figure 1:
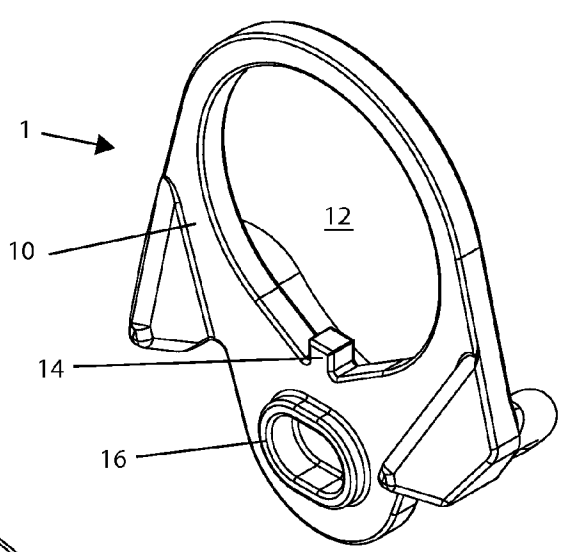
FIG. 1 is a front, left, top perspective view of a rear sling fitting made in accordance with the described invention.
Figure 2:
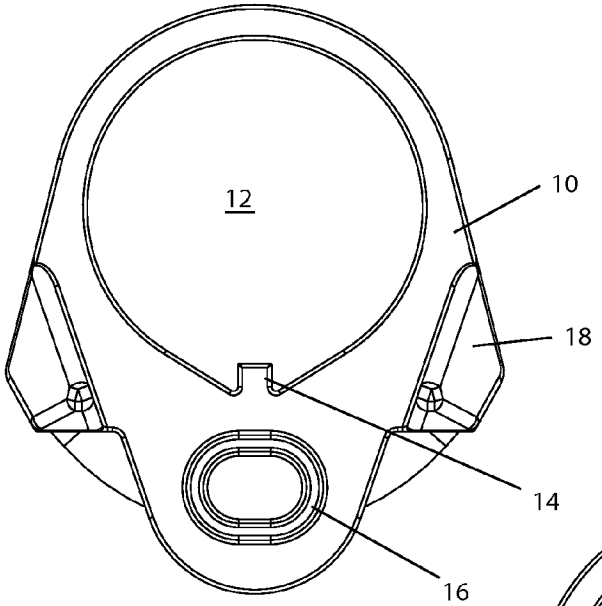
FIG. 2 is a front plan view of the sling fitting of FIG. 1.
Figure 3:
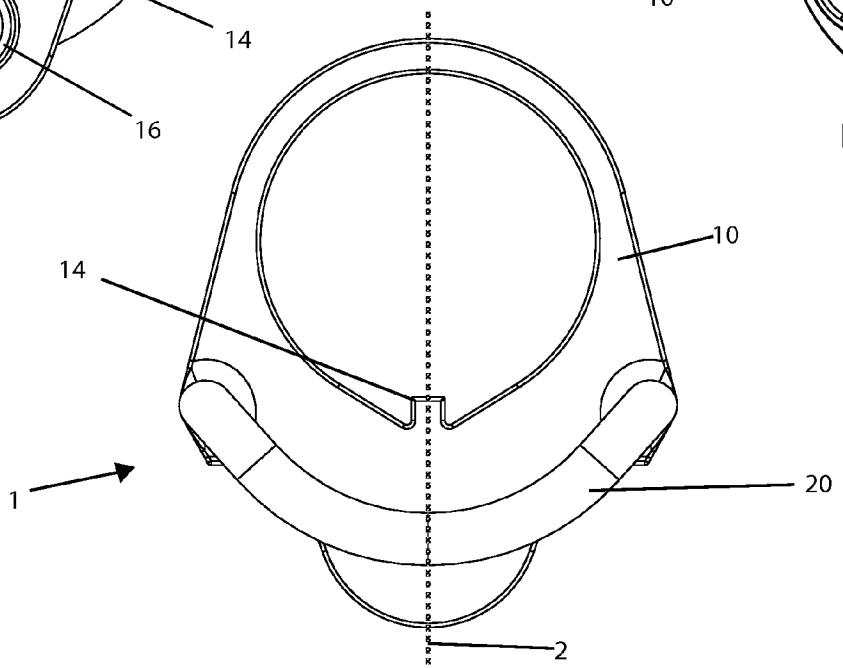
FIG. 3 is a rear plan view of the sling fitting of FIG. 1.
Figure 6:
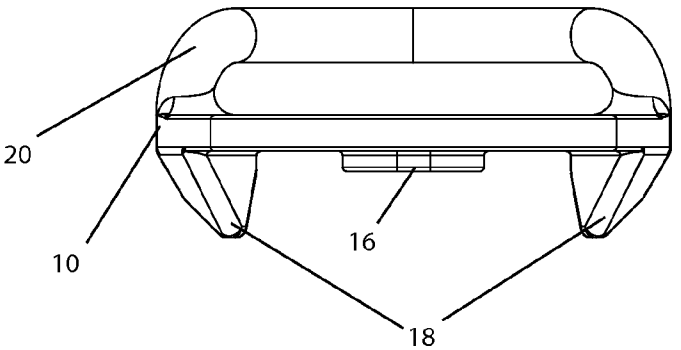
FIG. 6 is a top plan view of the sling fitting of FIG. 1.
Figure 7:
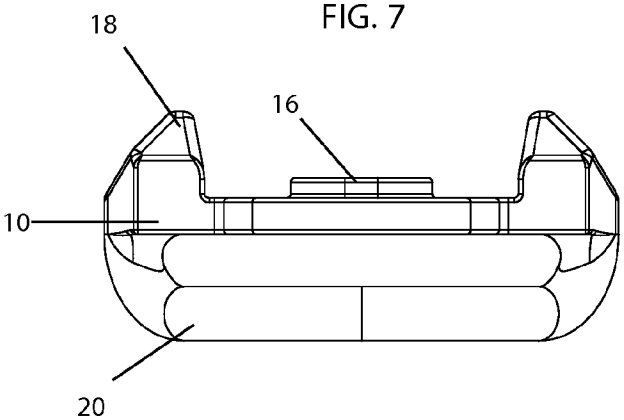
FIG. 7 is a bottom plan view of the sling fitting of FIG. 1.
Figure 5:
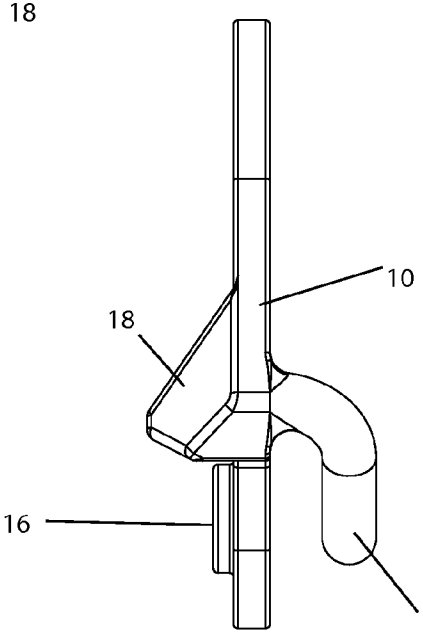
FIG. 5 is a left plan view of the sling fitting of FIG. 1.
Figure 4:
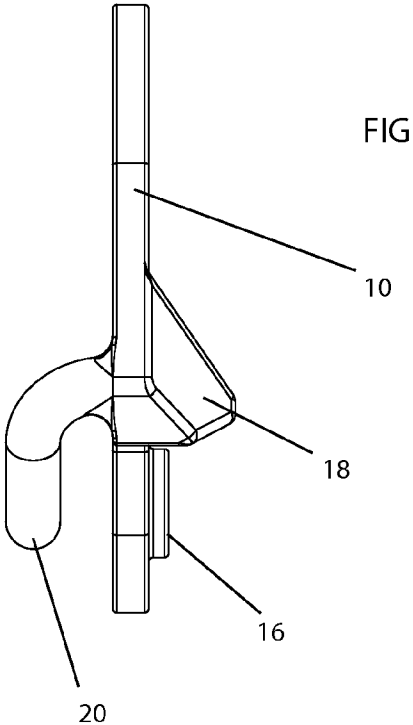
FIG. 4 is a right plan view of the sling fitting of FIG. 1.
Figures 8, 9, 10, 11:
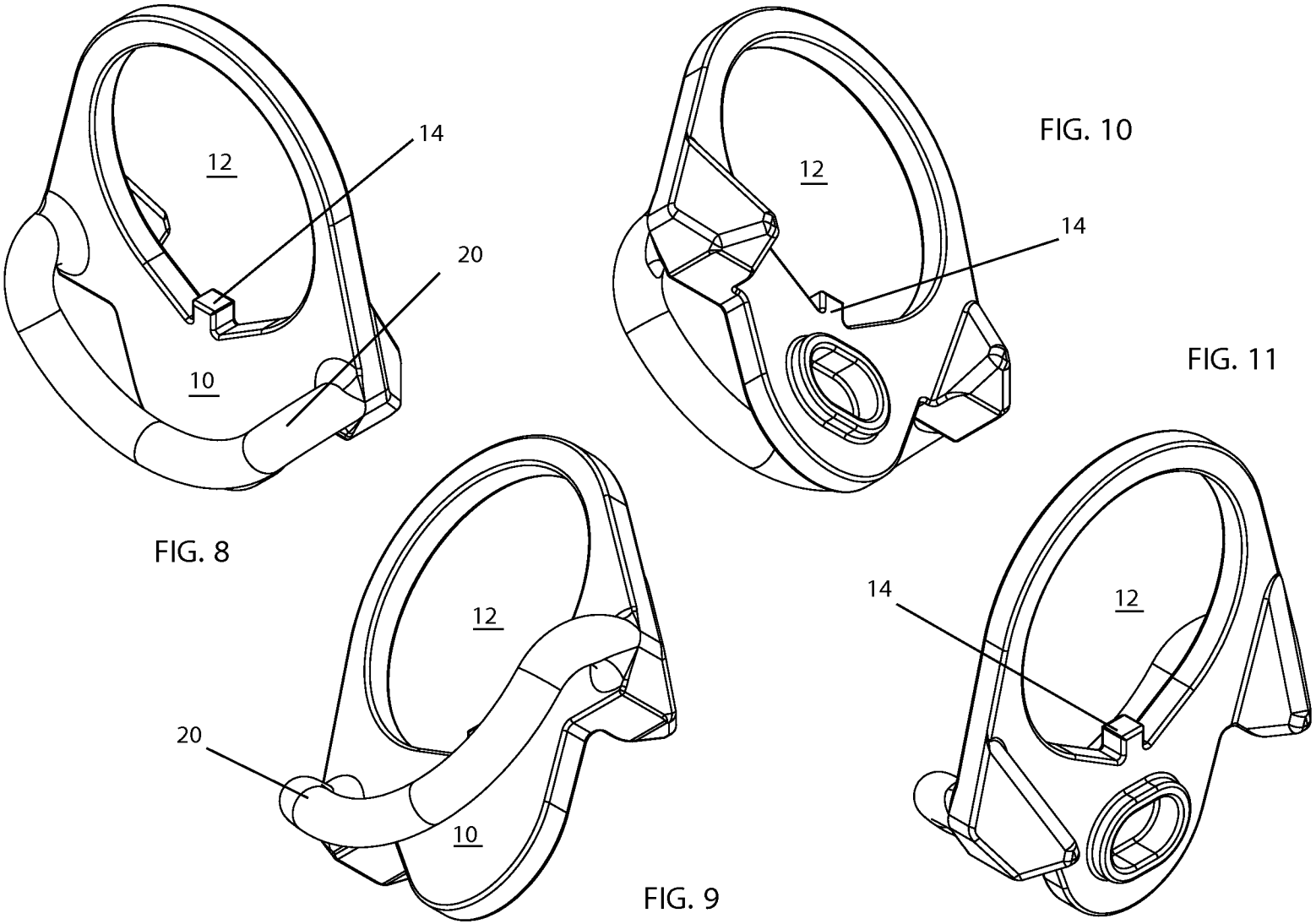
FIG. 8 is a rear, right, top perspective view of the sling fitting of FIG. 1.
FIG. 9 is a rear, right, bottom perspective view of the sling fitting of FIG. 1.
FIG. 10 is a front, right, bottom perspective view of the sling fitting of FIG. 1.
FIG. 11 is a front, right, top perspective view of the sling fitting of FIG. 1.
Figure 13:
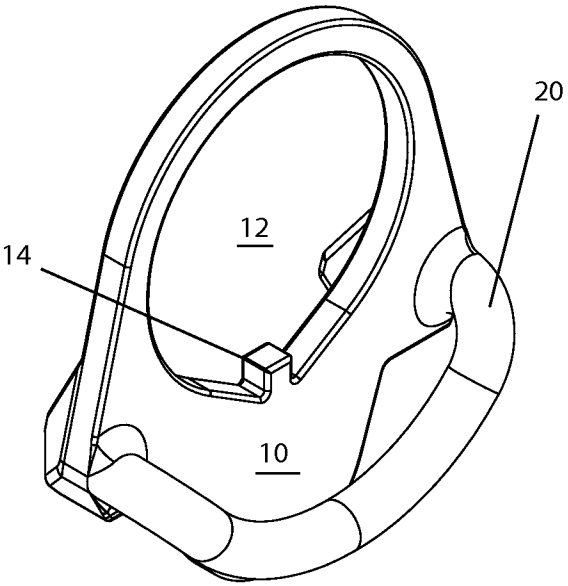
FIG. 13 is a rear, left, top perspective view of the sling fitting of FIG. 1.
Figure 14:
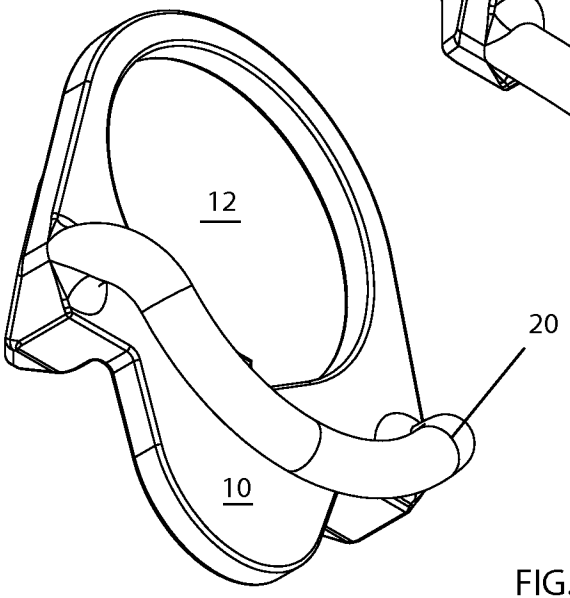
FIG. 14 is a rear, left, bottom perspective view of the sling fitting of FIG. 1.
Figure 12:
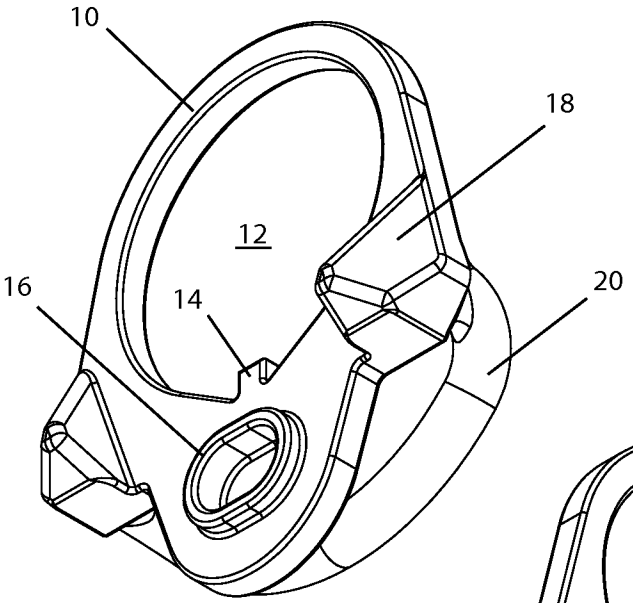
FIG. 12 is a front, left, bottom perspective view of the sling fitting of FIG. 1.
Figure 15:
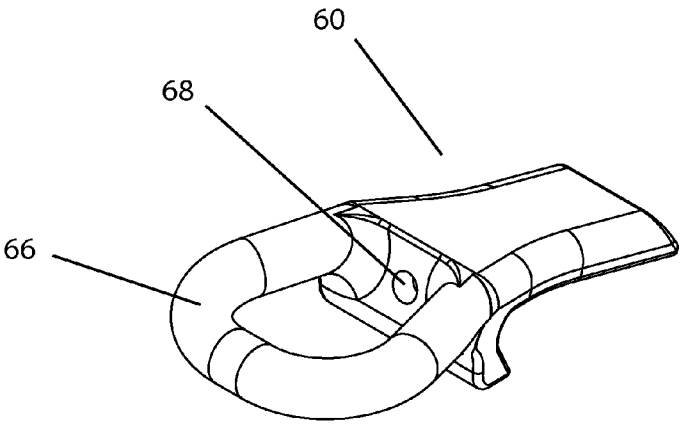
FIG. 15 is a front, left, top perspective view of a front sling fitting made in accordance with the described invention.
Figure 17:
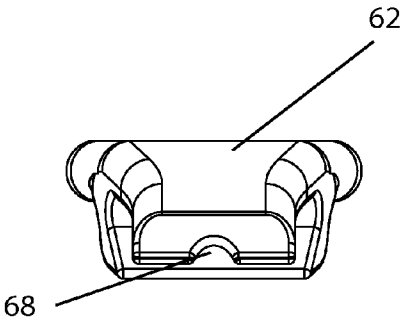
FIG. 17 is a rear plan view of the sling fitting of FIG. 15.
Figure 16:
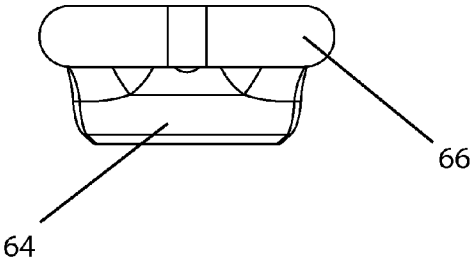
FIG. 16 is a front plan view of the sling fitting of FIG. 15.
Figure 21:
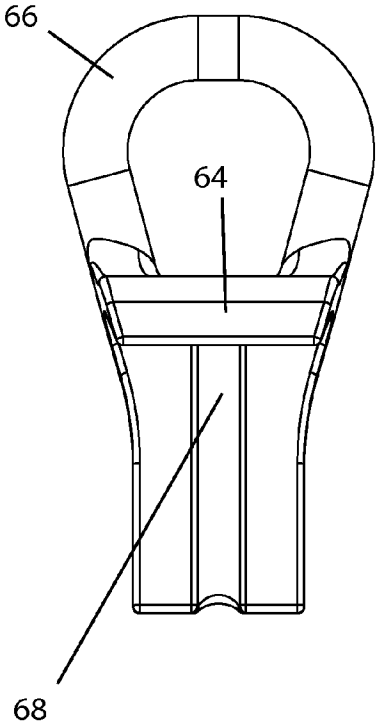
FIG. 21 is a bottom plan view of the sling fitting of FIG. 15.
Figure 20:
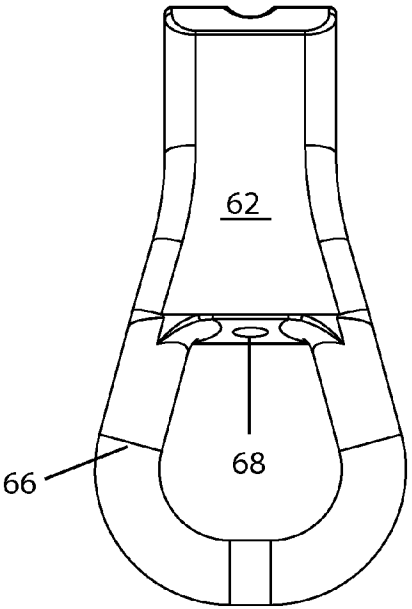
FIG. 20 is a top plan view of the sling fitting of FIG. 15.
Figure 18:
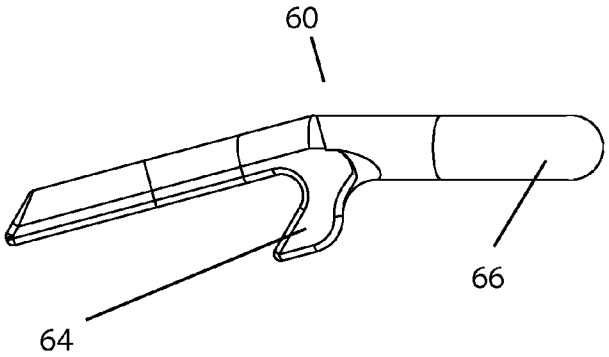
FIG. 18 is a right plan view of the sling fitting of FIG. 15.
Figure 19:
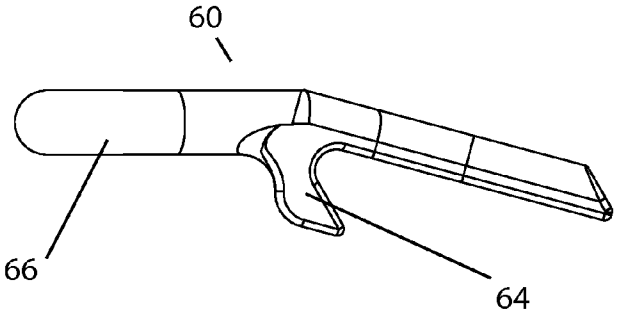
FIG. 19 is a left plan view of the sling fitting of FIG. 15.
Figure 24:
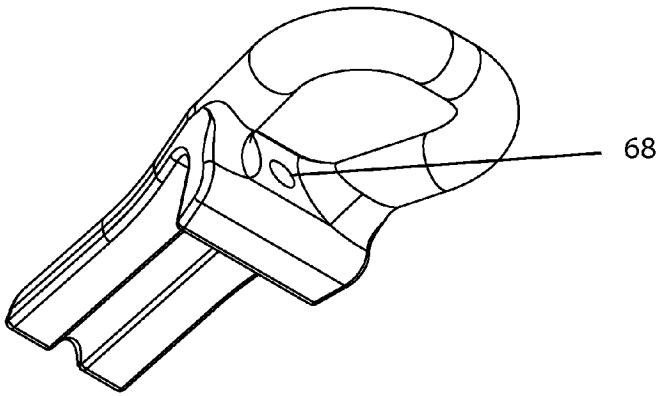
FIG. 24 is a front, right, bottom perspective view of the sling fitting of FIG. 15.
Figure 25:
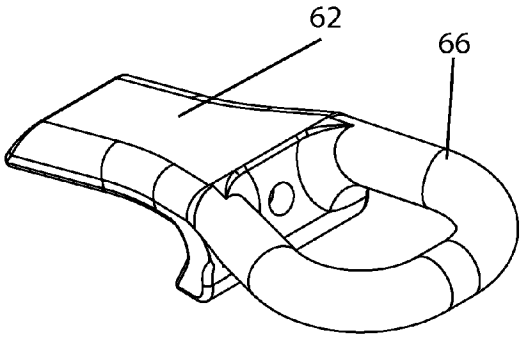
FIG. 25 is a front, right, top perspective view of the sling fitting of FIG. 15.
Figure 22:
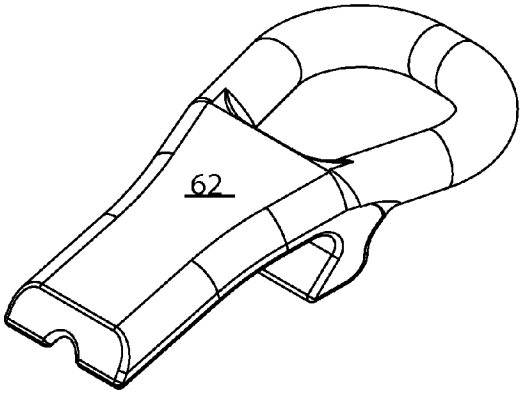
FIG. 22 is a rear, right, top perspective view of the sling fitting of FIG. 15.
Figure 23:
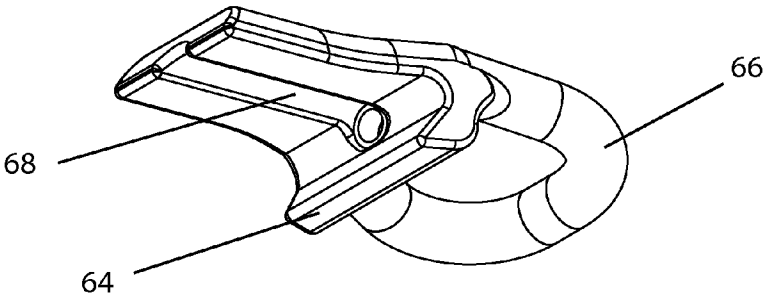
FIG. 23 is a rear, right, bottom perspective view of the sling fitting of FIG. 15.
Figure 27:
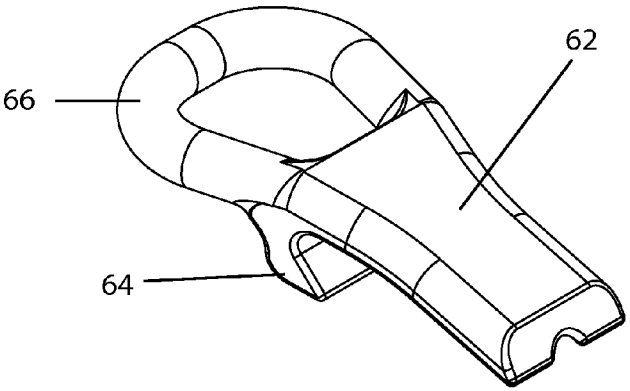
FIG. 27 is a rear, left, top perspective view of the sling fitting of FIG. 15.
Figure 28:
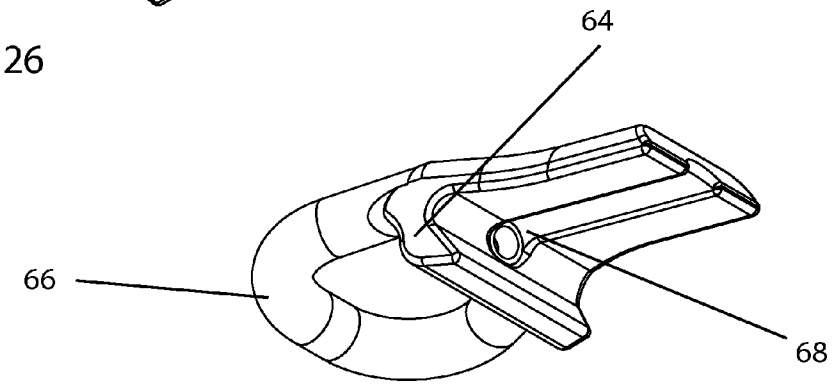
FIG. 28 is a rear, left, bottom perspective view of the sling fitting of FIG. 15.
Figure 26:
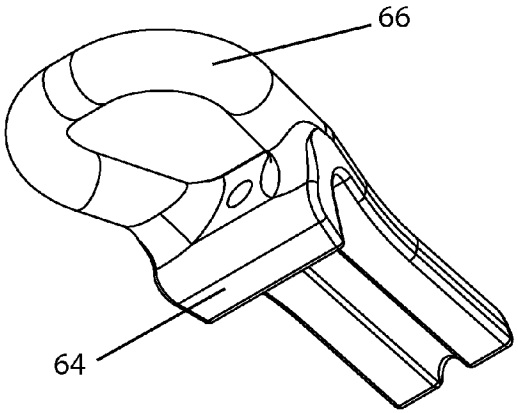
FIG. 26 is a front, left, bottom perspective view of the sling fitting of FIG. 15.
Figure 29:
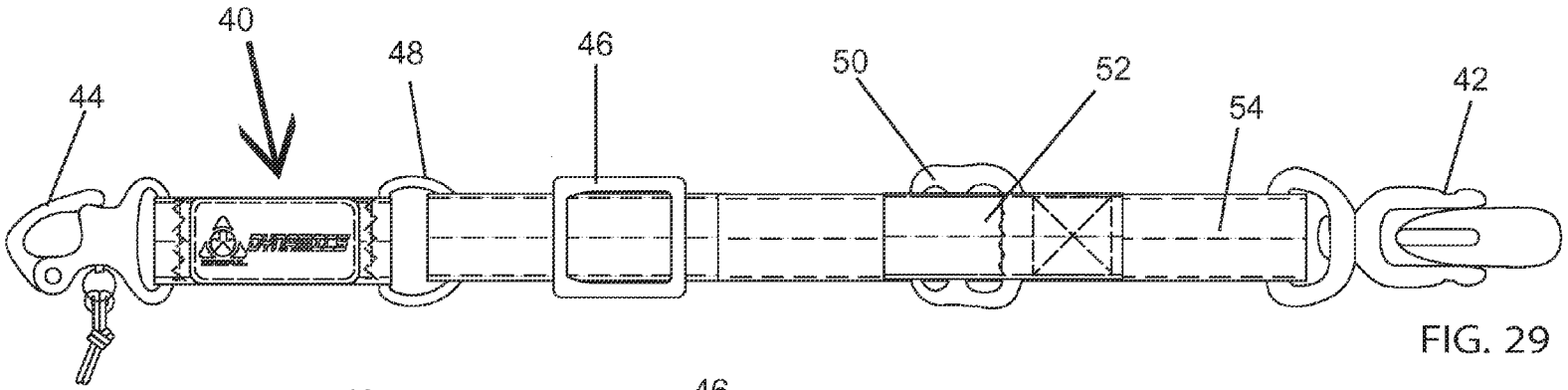
FIG. 29 is a top plan view of a sling for the present invention.
Figure 30:
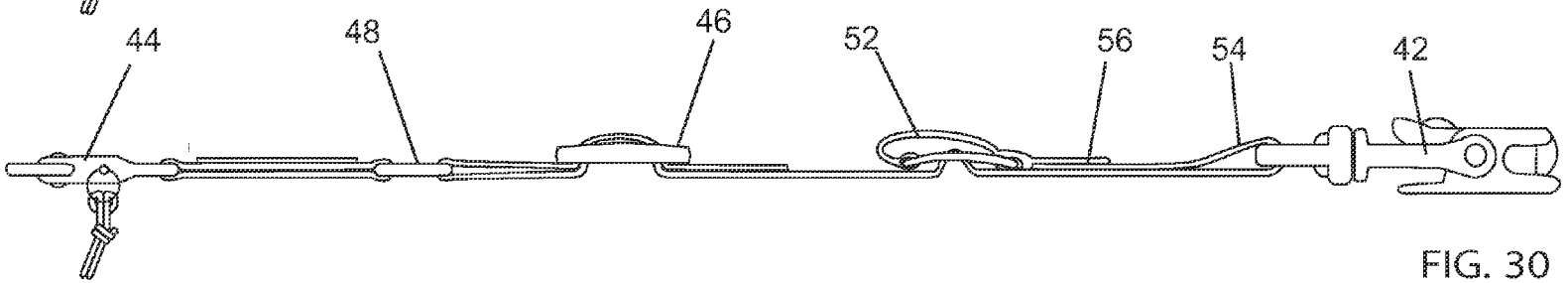
FIG. 30 is a side plan view of the sling of FIG. 29.
Figure 31:
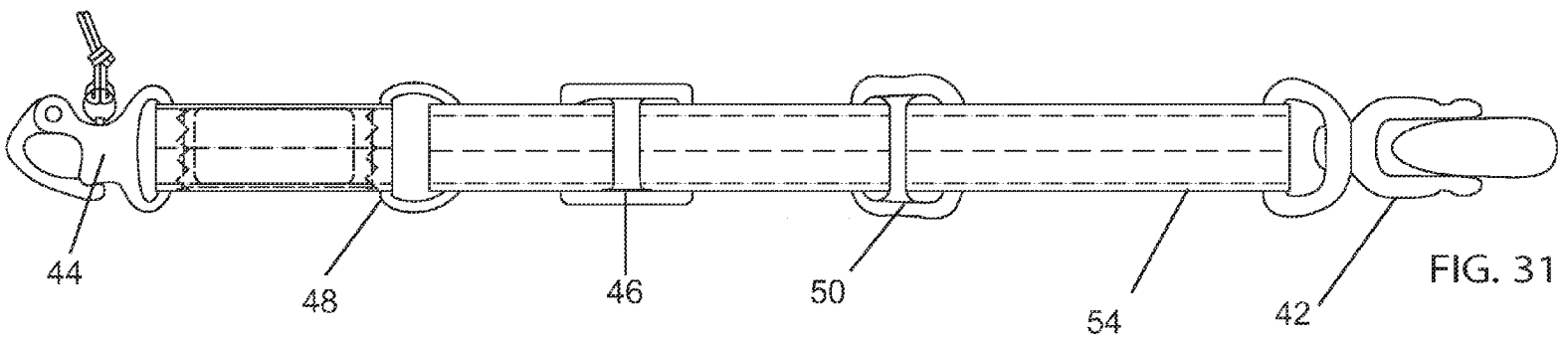
FIG. 31 is a bottom plan view of the sling of FIG. 29.
Figure 37:
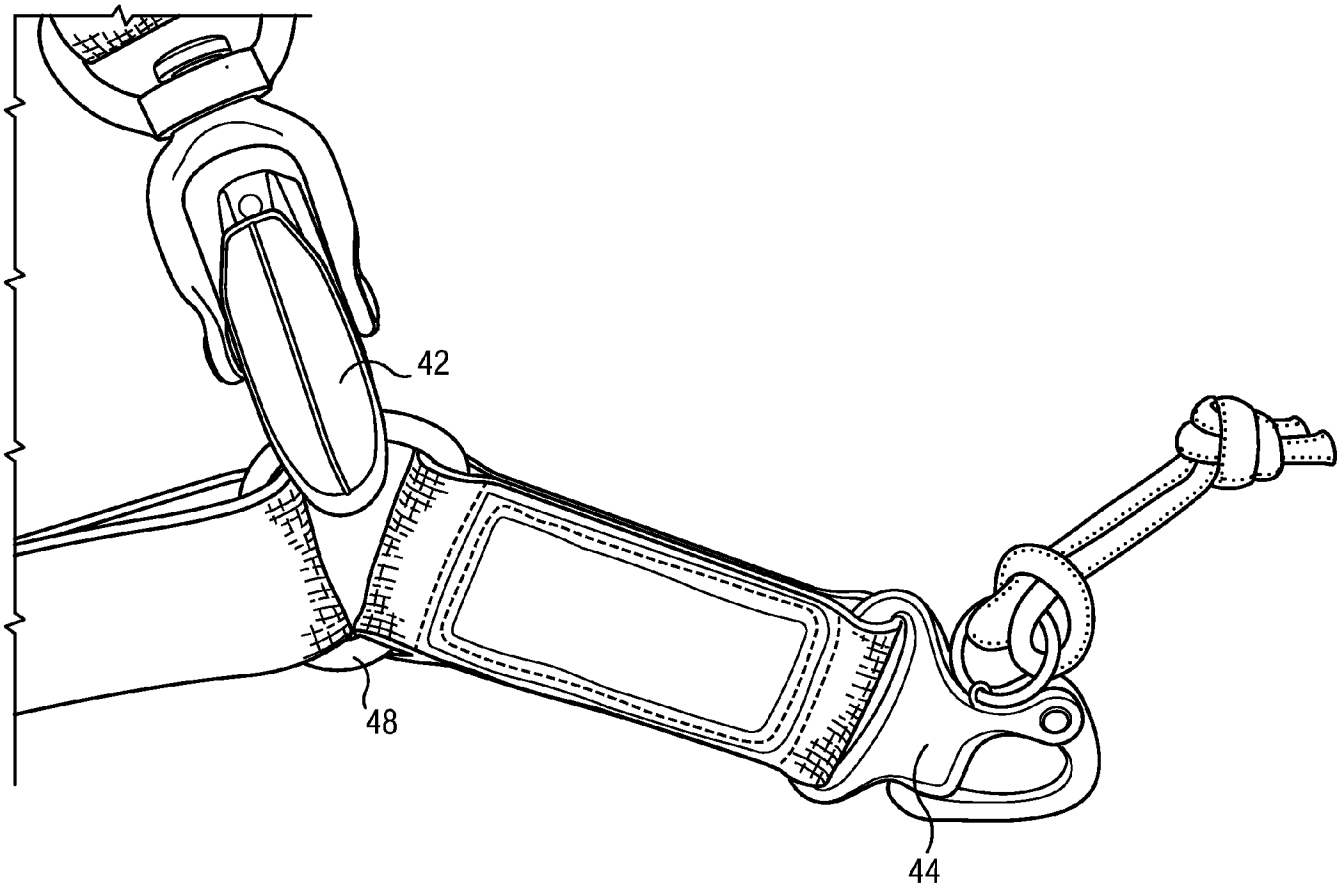
FIG. 37 is a close-up plan view of the sling of FIG. 29, in a single point attachment mode.

A preferred sling is disclosed in FIGS. 29-31. The preferred sling is comprises a strap 40 with two ends featuring connection hardware 42, 44. The preferred fore end connection hardware 42 being a clip, like the "alligator" style clip depicted, while the rearward connection hardware 44 is preferred to be less easily opened, somewhat narrower, and securely locked for use, such as the snap-hook connector shown in the Figures. Any known or later discovered clip or securing mechanism may be used for the sling connection hardware 42, 44. For a two-point connection paradigm, the ends connect to a forward mounting point (like connection loop 66) on the weapon and the connection bar 20. The sling is convertible from a two-point to a one-point connection paradigm by removing the fore end 42 from the forward mounting point and securing it to connection ring 48 located near but not proximate the rearward end 44, as shown in FIG. 37. This creates a continuous loop for securing the weapon to the user. A rapid adjustment buckle 50 is located on the sling 40 and folds a length of the sling on itself 54 to shorten its overall length. A handle 52 is located on the buckle 50 for easier manipulation of the buckle 50 so that it may slide relative to the sling 40 and either increase or decrease the folded portion of the sling 54, and thereby affect the length of the sling 40. In use, the handle 52 is a thumb loop connected to both edges of the rapid adjustment buckle 50 and the end of the sling fabric 56 so that the user may hook the handle 52 with a thumb and thereby bias the buckle into a more free flowing position relative the sling 40 for easier adjustment. A regular adjustment buckle 46 may also be provided. The sling may be made of any suitable material, including nylon webbing or other fabric, with the connection hardware also being any known means to clip the sling onto the connection points. Suitable materials for the connection loop 48 and buckle 50 may be a durable plastic or metal such as brass, steel or aluminum.

In use, a sling is attached to the connection bar 20 through a point-type attachment like snap loop 44. The connection bar 20 spans a distance beneath the aperture 12 and projects generally perpendicularly from the fitting body 10. Positioning then is just behind the receiver, below the stock, as shown in FIG. 36. Connection bar 20 may bow slightly to conform to the shape of the aperture 12 and in so doing likewise conform to the shape of a receiver tube and the stock. The connection bar 20 spans across an axis of symmetry 2 (FIG. 3) in regards to the shape of the fitting body 10, so that portions of the bar can be said to reside on a left side or a right side of the fitting body. When a point-style sling is attached, the attachment clip 44 may then slide along the connection bar 20 to either a left or a right side of the fitting, thus allowing the sling to slide along a left or right side of the weapon. This then provides the adaptability desired over the prior art. The connection point may be a link 70 mounted upon connection bar 20, as shown in FIGS. 34-36. Use of a link 70 provides greater articulation of the joint and thereby increases the range of motion of the sling so that there may be over 180 degrees of motion about the mounting point of the sling. This in turn aids greatly in the adaptability of the sling to different stances and positions of the user.

Although the present invention has been described with reference to preferred embodiments, numerous modifications and variations can be made and still the result will come within the scope of the invention. No limitation with respect to the specific embodiments disclosed herein is intended or should be inferred.

What is claimed is:

1. A sling system comprising:

a. a rear sling mount;

b. a forward sling mount;

c. a first flexible strap having two ends, one being fitted with connection hardware suitable for interfacing with the rear sling mount;

d. a second flexible strap having two ends and having connection hardware, movable in relation to the second flexible strap and suitable for interfacing with the forward sling mount;

e. a connection ring joining the first and second flexible straps by their respective ends which do not have connection hardware;

f. at least one adjustment buckle, situated on the second flexible strap such that the strap folds over itself, creating an adjustment loop that contains the connection hardware of the second strap, a size of which is dependent upon the buckle's location relative the strap; and g. a handle located on at least one adjustment buckle to facilitate manipulation of the adjustment loop, said handle further comprising a thumb loop with first and second ends, the first end connected an end of the second flexible strap and a forward edge of the buckle, the second end connected to a rearward edge of the buckle;

wherein the sling converts from being mounted on two points to one point by removing the connection hardware from the forward sling mount and placing it on the connection ring, thereby creating a loop wearable on a user.

2. The sling system of claim 1, the rear sling mount further comprising:

a planar fitting body having an obverse face and reverse face and an aperture in a top portion of said sling fitting body;

a registration body projecting from the obverse face of the fitting body, beneath the aperture;

a connection bar with two prong ends, each prong end fixedly connected to the reverse face of the fitting body such that the connection bar is located generally opposite from the registration body and crosses an axis of the fitting body such that a portion of the connection bar may be able to be said to be on a right half of the fitting body and another portion may be said to be on a left side and the connection bar resides, except for the prong ends, in a plane parallel to a plane defined by the fitting body.

3. The sling fitting of claim 2, further comprising at least one registration tab extending into the aperture from a circumference of the aperture.

4. The sling fitting of claim 2, further comprising at least one registration slot fashioned along a circumference of the aperture.

5. The sling fitting of claim 4, further comprising at least one other registration projection.

6. The sling fitting of claim 5, further comprising a link situated on the connection bar.

7. The sling fitting of claim 2, further comprising at least one other registration projection.

8. The sling fitting of claim 7, further comprising a link situated on the connection bar.

9. The sling fitting of claim 2, further comprising a link situated on the connection bar.

* * * * *